US007954821B2

(12) United States Patent
Reabe, Jr.

(10) Patent No.: US 7,954,821 B2
(45) Date of Patent: Jun. 7, 2011

(54) WORLD CUP OF BLACKJACK

(76) Inventor: Gordon F. Reabe, Jr., Lees Summit, MO (US)

( * ) Notice: Subject to any disclaimer, the term of this patent is extended or adjusted under 35 U.S.C. 154(b) by 561 days.

(21) Appl. No.: 11/820,348

(22) Filed: Jun. 19, 2007

(65) Prior Publication Data

US 2008/0315521 A1 Dec. 25, 2008

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 5,257,810 | A * | 11/1993 | Schorr et al. | 273/292 |
| 5,823,879 | A | 10/1998 | Goldberg et al. | 463/42 |
| 5,934,675 | A | 8/1999 | Handelman et al. | 273/292 |
| 6,183,366 | B1 | 2/2001 | Goldberg et al. | 463/42 |
| 6,264,560 | B1 | 7/2001 | Goldberg et al. | 463/42 |
| 6,311,978 | B1 * | 11/2001 | Moody | 273/292 |
| 6,354,592 | B1 | 3/2002 | Virzi | 273/138.1 |
| 6,406,023 | B1 * | 6/2002 | Rowe | 273/292 |
| 6,712,702 | B2 | 3/2004 | Goldberg et al. | 463/42 |
| 6,719,291 | B1 * | 4/2004 | deKeller | 273/274 |
| 6,752,394 | B2 * | 6/2004 | Malcolm | 273/292 |
| 6,773,013 | B2 * | 8/2004 | Caldwell | 273/292 |
| 6,896,265 | B1 * | 5/2005 | Schlumbrecht | 273/292 |
| 6,959,928 | B2 * | 11/2005 | Schultz | 273/292 |
| 7,201,375 | B2 * | 4/2007 | Adam et al. | 273/292 |
| 7,222,855 | B2 * | 5/2007 | Sorge | 273/292 |
| 7,261,298 | B1 * | 8/2007 | Schlumbrecht | 273/292 |
| 7,309,066 | B2 * | 12/2007 | Donaldson | 273/292 |
| 7,354,041 | B2 * | 4/2008 | McKee et al. | 273/292 |
| 7,380,794 | B2 * | 6/2008 | Noyes | 273/292 |
| 7,438,295 | B2 * | 10/2008 | Aida | 273/292 |
| 7,510,191 | B1 * | 3/2009 | Schlumbrecht | 273/292 |
| 7,510,193 | B1 * | 3/2009 | Schlumbrecht | 273/292 |
| 7,527,267 | B2 * | 5/2009 | Webb et al. | 273/292 |
| 7,530,572 | B2 * | 5/2009 | Thomas et al. | 273/274 |
| 7,584,967 | B2 * | 9/2009 | Webb et al. | 273/292 |

* cited by examiner

*Primary Examiner* — Gene Kim
*Assistant Examiner* — Dolores Collins
(74) *Attorney, Agent, or Firm* — Mark A. Litman & Associates, PA

(57) ABSTRACT

A method of playing a casino table wagering game of blackjack has the steps of: at least one player and preferably at least two players placing individual wagers on an underlying blackjack game; an initial 2-card common player hand is dealt; an initial 2-card dealer hand is dealt, with rank of one card of the initial 2-card dealer hand exposed to view; each player making independent decisions on the play of the player's hand to complete of the common hand for each individual player's hand using only community cards; completing the dealer's hand; and resolving all wagers. A series of player count identifying areas may be provided and individual player identifiers are placed in the areas. The player count areas comprise six areas separately representing player counts of a) 16 or less, b) 17; c) 18; d) 19; e) 20; and f) 21. The method may include at least two separate common player hands being dealt and individual players may elect to place a separate wager on either of the at least two hands or both of the at least two hands. The method may be used in a blackjack tournament and the tournament includes multiple tables and multiple rounds of play.

16 Claims, 1 Drawing Sheet

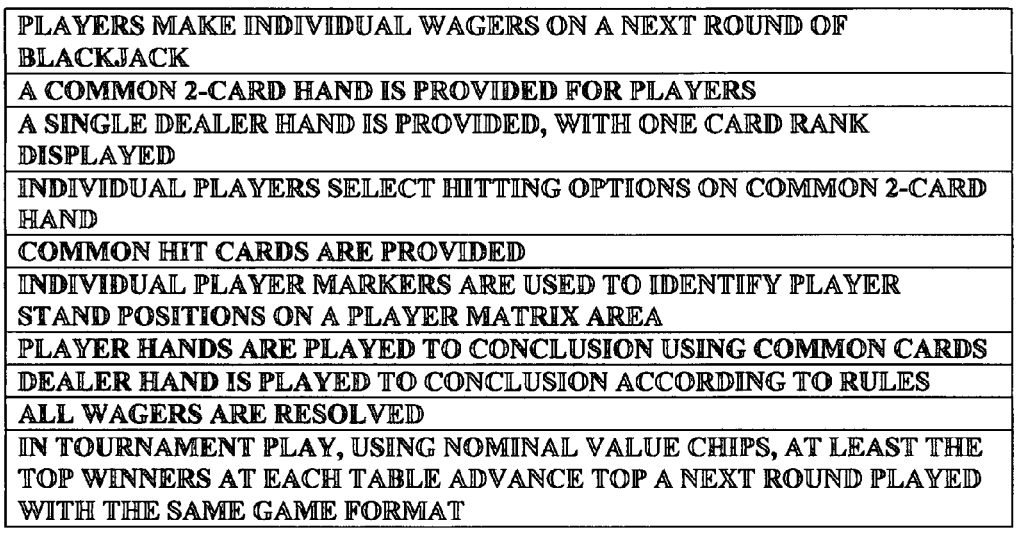

FIG. 1

| |
|---|
| PLAYERS MAKE INDIVIDUAL WAGERS ON A NEXT ROUND OF BLACKJACK |
| A COMMON 2-CARD HAND IS PROVIDED FOR PLAYERS |
| A SINGLE DEALER HAND IS PROVIDED, WITH ONE CARD RANK DISPLAYED |
| INDIVIDUAL PLAYERS SELECT HITTING OPTIONS ON COMMON 2-CARD HAND |
| COMMON HIT CARDS ARE PROVIDED |
| INDIVIDUAL PLAYER MARKERS ARE USED TO IDENTIFY PLAYER STAND POSITIONS ON A PLAYER MATRIX AREA |
| PLAYER HANDS ARE PLAYED TO CONCLUSION USING COMMON CARDS |
| DEALER HAND IS PLAYED TO CONCLUSION ACCORDING TO RULES |
| ALL WAGERS ARE RESOLVED |
| IN TOURNAMENT PLAY, USING NOMINAL VALUE CHIPS, AT LEAST THE TOP WINNERS AT EACH TABLE ADVANCE TOP A NEXT ROUND PLAYED WITH THE SAME GAME FORMAT |

FIG. 2

2

DEALER POSITION

| | | | | | |
|---|---|---|---|---|---|
| 16 or less | 17 | 18 | 19 | 20 | 21 |
| 4 | 6 | 8 | 10 | 12 | 14 |

WORLD CUP OF BLACKJACK

BACKGROUND OF THE INVENTION

1. Field of the Invention

The present invention relates to tournament style blackjack and casino style blackjack.

2. Background of the Art

Tournament play in casino table card games and other wagering card games has grown exponentially in recent years. Events are regularly televised and players enter major tournaments from all over the world. Top prizes in some of the more prestigious poker tournaments are presently multimillion US dollar prizes.

Blackjack tournaments have not the prize levels or interest of poker, primarily because blackjack tournament results are more a reflection of luck of the draw and seat location rather than skill and cunning like poker. Also with poker a player can improve skills by playing in cash games, online and at casinos. With blackjack however, playing regular blackjack in a casino doesn't help a player improve skills needed for a traditional blackjack tournament. Thus with no learning process to motivate a player to pursue perfecting results in blackjack tournaments, most players only play in free casino sponsored or $50 entry fee events with blackjack.

Most blackjack tournaments utilize six deck shoes and between six to eight players per table. Each and every player in the tournament begins with a certain and equal "chip count." These are called tournament chips, and in many but not all tournaments, they have no genuine monetary value in the remainder of the casino. Players usually pay an entry fee with the prize money accumulated from the fees and distributed on a format that rewards the winner with a largest percentage of total purse at a cutoff point (usually requiring a specific number of hands at each table for each round of play). Lower amounts of the prize money are paid to lower ranking finishers with a cutoff on the rank of finisher depending on the initial set-up of the game and the desired levels of payout awards to the ranked players.

The play at each table in the tournament usually begins with the dealer placing a white button (dealer button) in front of the player randomly selected to place the first bet on the first hand at the table. This is done because there can be some strategic advantage in placing later or the last bet in each round. The button rotates throughout the rounds so that all players will have similar statistical distributions of overall start and play positions. After all players have placed bets, the play commences with cards being dealt in a conventional manner and each player receives two starting cards as in traditional casino table play for blackjack, and one of the dealer's two cards is turned face up. Hit, stand, split, insurance and double down decisions are signaled to the dealer player by player until all have finished each round of card play by the players. The dealer finally flips over the dealer hole card and takes hits according to standard blackjack rules—stand on a hard 17 and continue to take hits until at least a hard 17 point count is reached. Chips are wagered and awarded by each player and each player, in turn, executes options on the play of the hand. After completion of a round of play and resolution of all wagers, the dealer slides "dealer button" to players left and the whole process repeats. Most tournaments have 20 to 30 hands dealt per round. At which time, a winner is declared (one with the most chips). At predetermined times, after hand 10, 20 or before the last hand is dealt for example, the dealer will count down everyone's individual chip total so that players will know where they stand. As the hands wind down, the play becomes very erratic and extreme. The reason is simple—people behind (chip count) must increase quickly or face elimination. Thus, the last five hands of most tournaments, people will double down on a blackjack, double down on 15's, etc. if they think it will help them win. Another strategy is how much to bet, based on how much a competitor bet and overall chip count. One or two key hands near the very end of the round usually determines tournament results. Successful tournament players must conserve their chip stack and play relative to others by betting low at the beginning of the round and hope others get unlucky and lose hands when they bet large amounts. They can then adjust bets based on their relative success throughout the 20 to 30 hand round.

Most accomplished and seasoned blackjack players understand that tournament formats as described above don't accurately test one's blackjack playing skills but are more of a crap shoot at the end of the round. Thus, the majority of the time the champion isn't the best blackjack player at the table, but usually the luckiest. He probably got a twenty at just the right time when is nearest chip rival busted out on a 16. These tournaments are very exciting as the tension mounts at the end (last few hands) but in no way is the overall winner the best blackjack player.

U.S. Pat. No. 6,354,592 (Virzi) describes a pyramid tournament in which every hour, two hundred players who pay a five dollar entry fee into a pool receive a known number of chips that are at risk during forty five minutes of play in an entry level game of a tournament. Of money in the pool, four hundred fifty dollars is paid into a pyramid fund, four hundred fifty dollars is paid to a winner of the entry level game, and one hundred dollars is paid to a tournament host. At the end of each week of a four week interval, there are 168 entry level game winners who have an opportunity to compete in a second level game of the tournament. At the end of each four weeks of a forty eight week interval, there are four second level game winners who have an opportunity to compete in a third level game. Winners of the second and third level games receive payouts from the pyramid fund. Winners of the third level games compete in a championship game of the tournament for all remaining money in the pyramid fund.

U.S. Pat. No. 5,934,675 (Handelman et al.) describes a blackjack game in which a set of first two cards of the "Player's" hand are dealt face up as a community hand and placed at a community hand location. The dealer also deals two cards to himself comprising one card face up and one card face down and placed at a dealer's hand location. Then the first two cards forming the community hand automatically receive hits until the numerical count of the community hand is at least 12. Other numerical counts can be used such as 9, 10 or 11. Each player then individually chooses to "Hit" or "Stand" on the community hand. The dealer then plays his two cards and winners and losers are determined in the conventional manner. In an alternative variation, the initial deal comprises one card to the dealer and one "Community Card". Then each player gets one card for his hand and the dealer receives a card for the dealer's hand. The single "Community Card" is shared by both the dealer and each player giving the dealer and each player a two card hand. The first two cards forming each player's hand automatically receive hits until the numerical count of each player's hand is at least 12. Other numerical counts can be used such as 9, 10 or 11. Each player then individually chooses to "Hit" or "Stand" on the community hand. The dealer plays his two cards (the first dealer's card and the "Community Card") and winners and losers are determined in the conventional manner.

Internet based tournament play is also generally described in numerous US patents such as U.S. Pat. Nos. 6,712,702; 6,264,560; 6,183,366; and 5,823,879.

It is desirable to set up a format of play with technical changes in blackjack play to give it a better opportunity to be well received as a competition of skill rather than just luck, as it often appears to be in conventional play. This will increase interest in conducting tournaments where players will be motivated to pay large entry fees similar to poker's World Series of Poker.

SUMMARY OF THE INVENTION

A method of playing a casino table wagering game of blackjack has the steps of: placing individual wagers on an underlying blackjack game; an initial 2-card common player hand is dealt; an initial 2-card dealer hand is dealt, with rank of one card of the initial 2-card dealer hand exposed to view; each player making independent decisions on the play of the player's hand to complete of the common hand for each individual player's hand using community player cards; completing the dealer's hand; and resolving all wagers. The cards completing the common hand may not be dealt separately to each player but are dealt only to the common hand. A series of player count identifying areas may be provided and individual player identifiers are placed in the areas. The player count areas comprise six areas separately representing player counts of a) 16 or less, b) 17; c) 18; d) 19; e) 20; and f) 21. The method may include at least two separate common player hands being dealt and individual players may elect to place a separate wager on either of the at least two hands or both of the at least two hands. All hits on the at least two hands are again community player cards in separate sets for each of the at least two hands. The method may be used in a blackjack tournament and the tournament includes multiple tables and multiple rounds of play.

BRIEF DESCRIPTION OF THE FIGURES

FIG. 1 shows a schematic diagram of play of the novel game.

FIG. 2 shows an example of a player's total matrix as it might appear on a game table.

DETAILED DESCRIPTION OF THE INVENTION

Regardless of the number of players at a table, only one player hand will be dealt.

In the present game, all players will act on the same initial two-card common blackjack hand throughout until all players have individually elected to stand or have busted on those same initial two-card common hands. With only one hand per table, the impact of luck has been reduced and all players are on an even playing field initially. There would be fewer complaints about other players receiving better initial hands (e.g., 20 counts while another player is receiving stiff hands—12 to 16). After the initial player hand is dealt, however, the individual player must then act independently to finish the hand, even though common hit cards are used to complete the common hand. Thus, at a given table, every hand starts off with the same hand versus the dealer's up card. At that point each player decides if they want to hit, stand, split, double or surrender just like conventional blackjack.

The technology may be generally described as a method of playing a casino table wagering game of blackjack comprising the steps of:

placing individual wager on an underlying blackjack game;

an initial 2-card common player hand is dealt face up;

an initial 2-card dealer hand is dealt, with rank of one card of the initial 2-card dealer hand exposed to view;

each player making independent decisions on the play of the player's hand to complete of the common hand using community player cards for each individual player's hand;

completing the dealer's hand; and resolving all wagers.

The cards completing the common hand may not be dealt separately to each player, but must be dealt in a central viewable area only to the common hand. A series of player count identifying areas may be provided and individual player identifiers are placed in the count identifying areas. The player count areas comprise, for example, up to six areas separately representing player counts of a) 16 or less, b) 17; c) 18; d) 19; e) 20; and f) 21. The 21 area may be optional because if a final count on a common players' hand is twenty-one (21), it can be assumed that all players remaining in the game who do not have player identifying markers in count identifying areas of less than 21 will have the final count of 21. The method may include at least two separate common player hands being dealt and individual players may elect to place a separate wager on either of the at least two hands or both of the at least two hands. The method preferably may be used in a blackjack tournament and the tournament includes multiple tables and multiple rounds of play. The method may use identical common player cards in hands at multiple tables for each round of play.

To assure ease of visualization of the common player 2-card hand to each player, either video displays may be available at each player position, count cards or counts may be provided or displayed at each player position, the common cards may be displayed on a screen on the table or behind the dealer and the like. A player display may also be provided that will display the 2-card common hand point total and/or a running hand count total at each player position. This can be done by reading cards being dealt (as from an intelligent dealing shoe, intelligent shuffler (that reads cards before or as they are dealt), or by using virtual decks to play the tournament game with playing cards virtually displayed as opposed to physical cards being dealt.

There are a number of variations in this technology that may be used. Players must use common hit cards provided to the table with players indicating (by electronic signals or preferably decision cards) at what point the players will stop receiving any additional hits by placing a final stand card.

One concern with everyone having the same starting hand becomes evident during ordinary play of the game. That concern is how the dealer decides how to administer the different options on how to proceed with the common hand. One player may want to hit, another stand, while another may want to split or double, and another may wish to surrender. Also in a tournament, it is one player against another and no one wants the other to know his or her decision before the other player has declared. The solution to this problem is another aspect that may be used in the present invention. The tournament may provide the use of decision cards (with a manual system), electronic decision entry or an automated screen where individual decisions can be made in secret and the dealer gets to see individual decisions on his master screen which cannot be viewed by the players. It is possible that at least one decision card (especially the stand card) can be automatically tracked (e.g., by RFID or other sensible system), and that the system can track automatically, without players seeing others' decisions, a final state of the game, wherein when all stand cards are placed by all players or the final common hand is a bust situation, the system will register and disclose to the dealer that dealing of player cards is complete. Decision cards will be initially discussed, as the cost is minimal versus the automated solution, although with the advancing use of electronics at gaming tables, widespread transition to electronics will become less expensive and more desirable.

The decision card can be used and provided as follows:

It would be constructed of traditional playing card stock with one side similar to conventional cards—colored pattern, uniform and indistinguishable from another.

The other side will be one of five separate cards—one simply says "stand", another "Hit", another, "Split" and the last "Double". An optional "Surrender" card could be utilized depending on tournament set up if surrender is allowed or not.

At the beginning of the each round, every player receives a "set" of decision cards to utilize on all playing decisions. They are held in the players hand and at the appropriate time, secretly pulled out of his stack and placed face down on the table next to his bet.

After all players have acted the dealer instructs the players to flip over their one decision card. Thus, no one knows beforehand how another player will initiate completion or finish the common hand. Players must be decisive and skillful to be successful with this format.

The dealer's job is just beginning in the tournament event, however, because of the potential different decisions being made on the one common hand. Rules should be provided on how the dealer concludes the playing of the common hand and how the dealer will keep track of each the players' individual card totals since no cards are distinctly provided to that player's position. This aspect of the invention solves that problem with the use of a "player's matrix" printed on the table which should be accessible by only the dealer. The matrix may consist of six distinct and separate boxes printed on the table—three to the left of card reader and three to the right. Reading from player left to right, first box will read 16 of less, second box will read "17" third box will read "18", fourth box will read "19" fifth box will read "20" and sixth box will read "21". An example of a matrix is provided in FIG. 2.

In front of the Dealer Position 2 are six separate identification positions, 16 or less 4, 17 count 6, 18 count 8, 19 count 10, 20 count 12 and 21 count 14.

To complete this phase of the invention description, small plastic or clay chips or lammers can be a part of the game. On the chips will be printed, painted or stenciled the numbers of the players 1, 2, 3, 4, 5, 6, 7 and 8, or however many players are present, which can be supplemented by on-line or hand-held data entry systems used with the table. Thus the position at which that player is sitting will become his player number for purposes of identifying him for the players matrix. Player #1 is the first player to the dealer's left and player #8 is the first player to dealer's right The player's Matrix will be used to identify individual players' total ending hand value. The dealer only will utilize the "matrix" when the common players hand is still live, that is when at least one player wants to continue hitting (drawing cards) and at least one other player has stopped hitting by placing a "stand" decision card down. Only the players who have stopped early will have their hand or hands identified by the dealer utilizing a numbered chip in the appropriate box in the matrix. Thus, if a player stands and no one else draws cards, by default after the dealer finishes his hand, the dealer compares his hand to the common players' cards left on the table to decide a winner. The dealer then utilizes the chips left on the player's matrix to settle up with those identified players. The matrix allows the play of the common hand to continue without worry of when an individual player stopped before another. The players will be identified so that the dealer doesn't have to try and remember individual card totals. An electronic version of the player's matrix could be utilized which would further simplify the identification process and is part of this invention.

An example of how the "matrix" works follows.

Assume in this example that the dealer's up card is a "2." The common hand's first two cards total "12" (which are always dealt face-up). Players 1, 2, 3 and 4 place stand cards down at this point. Players 5, 6, 7 and 8 place hit cards down. At this point, dealer takes small lammer chips numbered 1, 2, 3 and 4 and places them in the 16 or less box on the players' matrix. The dealer then hits the common hand as instructed by players 5 through 8. Assume that the first hit card is an ace for a total count of "13." Player 5, 6 and 7 place a "Stand" decision card at their position and Player #8 places a "hit" card at his position. The dealer takes the small chip identifiers #5, #6, and #7 and places them in the 16 or less matrix box. He then hits the common hand a third time and the card is a "5" for a total of "18." Player #8 places a "stand" card face up at his position at this time. Since everyone else has previously taken a Stand position, no more "hits" will be made on the common hand in this round. The dealer does not need to identify the total for player #8 in the matrix, but for purposes of consistency this may be done. The hand total for Player #8 is the sum of the total of the four cards on the table—18 and all the other players' totals have been identified. The dealer then turns over his hole card and proceeds to draw until he has at least a "17" according to traditional blackjack rules. Assume the dealer has a 10 in the hole for a two-card total of "12". He must draw another card which in our example is a "5" for a total of 17 and he must stop drawing cards. He then must pay only player #8 whose total on the table is "18" and the rest of the players "lose" their wagers because their totals as identified by the player's matrix is "16 or less." The dealer gathers up their chips and the next hand commences.

An exception to the above description of utilization of the matrix boxes is when a player doubles down on a hand and at least one other player indicates a hit. Since by blackjack rules a player can only double down after the first two cards are exposed, his card total will always be the sum total of the first three cards dealt. Thus, there is no need to further identify his hand utilizing the players "matrix." This will save time and make it easier for the dealer. The players always will leave their last decision card next to their bet to identify to the dealer what their last decision was. If the player requests a card and the resulting hit causes them to break, the dealer immediately takes their bet off the table and the player is free to pick back up his "hit" decision card and get ready for the next hand.

Another example of a play variation with the matrix is in use of a split hand. Assume the common hand is a "4" and "4" and the dealers' up card is a "6." Player 1, 2, and 3 place "hit" cards down. Players 4, 5 and 6 place "double cards down and Players 7 and 8 place "split cards down. Players 4, 5 and 6 place a bet equal to or less than their original bets next to the original bet (for the additional wager required for a double down play). Players 7 and 8 place bets exactly equal to their original bet next to their original bet. Players 1, 2, and 3 do nothing at this point in the round. Assume the next card dealt to the common hand is a "4". Players 4, 5 and 6 can do nothing more with respect to play of the cards since they doubled down and are not allowed to take any more cards or make any additional wagers. The dealer need not identify their card total of "12" because by definition of the double down, their total is the first three cards of "12." For purposes of consistency, it is possible to use the player markers. Players 1, 2, 3, 7 and 8 must place a new decision card down at this time.

Assume that some of those players (1 and 2) place stand cards at this time. The dealer places lammers identified by "1" and "2" on the matrix box "16 or less." Player 3 wants another hit so he places a "hit" decision card down. Assume the card is a "7." The dealer places the labeled #3 in the box identified as "19" after player #3 places his "stand" card down.

Players 7 and 8 had originally asked for a split. The third card was a "4". Player 7 placed a double card and placed another bet equal to the original bet next to hand #1 (first player #7 bet circle). His total on the first split hand is 4+4+7 or "15." (The one he doubled after the split). The dealer will place lammer #7 on the 16 or less (for his first split hand) in the matrix box. Player #8 after the third card of "4" was drawn placed a "split" decision card down for his third hand, and another bet equal to the first bet goes down in an area designated for the split hand. The next card is a "7" as previously stated at which time player #8 places a double down decision card down and places another bet equal to or less than original bet next to the original hand one wager. Assume that the next card is a "10." There is no need for dealer to place total in matrix box since no one else is drawing on that hand, as Player #8 doubled down. A marker may be used, however, for consistency. Player #7 places stand card down for his total of 14 on second split hand. Since player #8 had resplit 4's a third time, for clarity the dealer would place another lammer #7 in the box labeled "16 or less." Player #7 now has two lammers (or chips) in the matrix. To identify which hand each lammer represents, the dealer places lammers on top of the lammer that was doubled down (hand #1) so he will know which bet it represents. The second hand or "14," not doubled, will receive a single lammer #7 as normally would occur. If neither of his hands had been doubled, there is no need to identify which hand is represented by a particular lammer because the amounts bet would be identical. Player #8 receives another ten-value card on his second hand and places a "stand" card. Again, no matrix is needed since no player is going to hit again. The last card is a "9" value card and player #8 places another stand decision card down for a "13" total. No matrix indicator is needed for this hand total as per previous hands discussion. The dealer is now ready to finish his hand by turning over his hole card and drawing out until he has a "17" or higher or breaks.

The example above will be one of the most complex hands encountered because of the different options afforded by an opening "4" "4" versus and exposed dealer card of a "6." The majority of the hands will be much more simplistic and direct. The unique features of this invention will enable blackjack tournaments to become much more of a fair and challenging experience. With common cards, each table in the tournament will produce a winner who knows how to play his cards versus the dealer and not rely on sitting in the lucky seat. With an electronic system, it is possible to have identical hands at multiple tables during the same event so that luck is less distributed even among tables. This would be preferably accomplished with a virtual deck being used by a random number generator, random cards provided for the Player hand and the Dealer hand, the information of those hands being relayed to each table and displayed as a virtual format, and the hands played out in this fashion indicated above. In fact, with an electronic system, lammers would not be needed as player input would be immediately registered in the system, hands would be immediately totaled, and resolution of wagers would be automatically affected. The electronic system would also be able to provide new randomized cards for each hand, since as few as four cards and a maximum of about 14 cards would be used in each round of play, however, all based on a depleting one virtual deck of cards with a stopping or re-shuffle point at ¾ of the deck for example.

The present invention produces a tournament winner that is more likely to be a blackjack expert with instincts and timely betting, and who only has to be better than the other players at his own table. It is also possible in an electronic system to eliminate the necessity for winning or placing at a table or getting into the finals with a consolation totaling of winnings. That is, in some tournaments, there are two winners from each table, and the tournament then may allow entry for the two players who did not finish in the top two at their table, but had the next highest winning amounts from among all other players. By using electronics and absolute winning amounts, someone who played extremely poorly, but did better than everyone else at his table would not get into the finals when identical hands are played among all tables electronically if there were enough players that finished with higher amounts. In this manner, the luck of being at a table with poor players would be eliminated, making advancement in the tournament even more skilled.

The first major change provided by the present technology was the use of the common hand as discussed above. The second major change was the ability to eliminate the moving betting and player button, as the players may place decision cards face down and then simultaneously turn the cards up to determine what action each player is going to take for each common player's card combination. With the use of this button, players take turns so that others can react to previously placed bets. The problem with its use is obvious. It is inherently unfair because the last few hands favor the one who gets to bet last. This creates a luck factor that can't produce fair results. As a result, the invention also introduces chip cards or other wagering instruments with denominations that can be completely hidden by placing the denomination face down without any indication provided from the sides or from the top-side that reveals the denomination. Special chips or domino-like tablets or cards may be used. Chip cards may be constructed of conventional playing card stock, so chip cards may replace the clay or plastic colored chips currently in use. One side is patterned, uniform in color indistinguishable from each other. The other side may contain a 3D image of a conventional chip in the typical denominations of $25, $100, $500, $1,000 and $5,000 and higher, depending on the tournament in traditional colors. Green for $25, black for $100, purple for $500, yellow for $1,000, white for $5,000, for example. Each player receives a set amount of these "chip cards" at the beginning of each round. A minimum and maximum betting amount will be set—$25 minimum and $5,000 maximum for example. Different minimums and maximums can be selected depending on starting chip stacks. Different card colors need to be utilized for the chip cards and decision cards at each table.

An alternative to chip cards would be an electronic touch screen or other screen with player input (e.g., buttons). Players would secretly select bet amounts that would be communicated electronically to the dealer. The dealer would increase or decrease total values based on the winning or losing of particular hands. In both cases, players are able to place bets without other players' knowledge, thus eliminating the need for a moving bet button. Thus, no luck factor on the last few hands in a tournament for the betting order advantage. With the manual system, the chip cards are kept face down in front of player and can be picked up and fanned out in a player's hand enabling him to pull out a card or combination of cards to bet face down in the betting square. The decision cards will be placed in the decision card square to the right of the chip card square.

Without prior knowledge of another players bet amount, each player is free to decide bet amounts using traditional blackjack game methods. Such as betting a hot streak, shortage of high or low cards, surplus of aces, doubling up after a loss, chipping up after a win, etc. What this allows for is blackjack as it was originally played, creating more freedom to utilize betting patterns without copycats. No countdown of totals need be used during play, which would tend to reduce the extreme plays and wagers typical at the end of rounds currently in place. Players will not be able to compute their relative chip position during play, thus doubling down on blackjack, crazy splits, etc. will not occur as often, resulting in fewer extremely lucky wins resulting from unorthodox plays.

In traditional blackjack tournaments, multiple tables are used simultaneously each with a different dealer and distinct sets of cards being dealt. Play is conducted with a fixed number of hands per round with winners advancing to subsequent rounds. With some formats a second or even third place table finisher advance. In other formats, after the winner (one player with the most chips), the balance of the non-winners are put in one pool (grouping) to determine secondary advancers. The tournament staff lists each player and their chip total and takes the top 20 chip leaders as an example to the next round eliminating everyone else. Of the above two possible scenarios, it is likely that the first more truly reflects the most worthy advancers. Because each table has dealer cards that vary, i.e., one table the dealer may break every hand, where as another dealer on another table may have "19" or "20" most hands. With this fact that each table results will vary significantly, it is logical to not decide advancers by comparing chip totals from players at different tables, unless the variation is described above where electronic displays provide identical series of cards at each table. Luck still plays into the picture, with most advancers coming from a table where the dealer broke more than another does. Luck of the draw on which table to sit at comes into play. Thus, advancers should be taken based on only comparing one player's total chips to the chips of other players at the same table. This will eliminate the luck factor on playing with a hot or cold dealer.

The present invention may also incorporate multiple sessions for players with random seat selection. This will overcome the possibility of all the best players sitting at one table and eliminating each other. This introduces a point system and multiple sessions before deciding on advancers and losers. This phase of the invention is optional, but would apply to the large $5000 or $10,000 initial player buy-in major blackjack championships—the World Cup of Blackjack. The reason that tournaments with a large buy-in for blackjack have not been attempted prior to this invention is obvious. Current blackjack tournaments are mostly determined by luck as previously discussed. With this fact, not many people want to risk that much money when results are for the most part out of their control. The present invention with the introduction of common cards, identical hit cards for all players, decision cards, chip cards, common hands for entire tables of players and now multiple table results using a point system that puts the control back into the hands of the player will revolutionize tourneys.

A point system may also be used with multiple table play. Each table has a number assigned to it, and each seat has a number also. Each player will be assigned a player number, e.g., based on when they paid for the tournament and registered. Let us assume that 1,600 players signed up and paid the $10,000 entry fee. With eight players to a table, 200 tables will be utilized. This tournament will be scheduled for at least five or six days similar to the World Series of Poker held at the Rio in Las Vegas. The objective would be to allow a participant five sessions, with each session being about one hour and a half the first day, with a required number of hands in that time frame. Each session seat and the table location would be arbitrarily determined prior to the start of play that day. At registration, a player would be given seat and table assignments for sessions one through five for that day. Since a computer or other random indicator made the selection, total randomness is utilized and it is fair to all participants. No seeding is attempted. The best players would be commingled with the normal players. Another important part of the invention involves the previously mentioned point system. The goal is to eliminate luck from the tournament and the points help to that end.

After session one is completed, the dealer at each table counts chips from each player that still has chips. Highest chip total player receives 8 points (assuming 8 players at table), 7 points for next highest, etc on down. One point for lowest or first one eliminated from the session. Tournament staff records individual chip totals in case there is a tie breaker necessary. After a 10 minute break or so, players report to predetermined second table and seat location. Session 2 commences for another 1 and ½ hours and results are tallied the same way as before. Sessions three through five are conducted in the same fashion. Thus after day 1 of the tournament, each player has played with five arbitrary dealers and 35 arbitrary players. Point totals have been accumulated only comparing individual play with that of the seven other players playing the exact hand you played for 1 and ½ hours. At the end of day one, the tournament director cuts ½ of the field—or in the example, 800 players. Total session points are added up and totaled for each player. The top half point gatherers advance. If there is a tie for the 800th place, a tie breaker is utilized. Assume 20 people have the same total for the 800th place. Those twenty people would then have their five session chip totals added together with the highest chip total advancing. The remaining days of tournament would be similarly conducted as the players are eliminated until only one is standing as World Champion.

A question may be raised—why not determine who advances by comparing chip counts for all five sessions for the entire field. The answer is obvious. It would allow for a potentially weak player to advance by virtue of having him sit at five tables where the dealer broke a lot and/or the player hands had a high concentration of 19, 20's and 21's. By utilizing the point system the ultimate advances will be the ones that beat the majority of the players on the tables they were playing at. Not having to worry about how their chip stack compares to another persons total at another table will free up the players to focus on the same hand. Also by having the tie-breaker in place, all competitors will not be able to coast in any one session if they happen to get a huge chip lead early in the session. They are motivated to accumulate maximum chips at each session to protect against losing in a tie-breaker.

Each session creates a new start with 7 new players with identical starting chip counts. Chips are always left at the table after each 1 hour or one-and-a ½ hour session and reset to beginning amount for all participants. For a $10,000 buy-in tournament, $10,000 chip cards could be provided to each player at the beginning of each session. Truly, as the tournament progresses the best blackjack players will survive because the absence of a lucky seat (use of the common hand), lucky table (use of the point system), lucky seat location (no dealer button) and five sessions with random players assigned to each table, no one competitor will gain an advantage or disadvantage playing with just one set of players.

The play of the novel game of the present technology may be played in a format shown in FIG. 1 wherein 1) PLAYERS MAKE INDIVIDUAL WAGERS ON A NEXT ROUND OF BLACKJACK; 2) A COMMON 2-CARD HAND IS PROVIDED FOR PLAYERS; 3) A SINGLE DEALER HAND IS PROVIDED, WITH ONE CARD RANK DISPLAYED; 4) INDIVIDUAL PLAYERS SELECT HITTING OPTIONS ON THE COMMON 2-CARD HAND; 4) COMMON HIT CARDS ARE PROVIDED IN A COMMON AREA OF THE TABLE; 5) INDIVIDUAL PLAYER MARKERS ARE USED TO IDENTIFY PLAYER STAND POSITIONS ON A PLAYER MATRIX AREA; 6) PLAYER HANDS ARE PLAYED TO CONCLUSION USING COMMON CARDS; 7) THE DEALER HAND IS PLAYED TO CONCLUSION ACCORDING TO RULES; 8) ALL WAGERS ARE RESOLVED; and 9) IN TOURNAMENT PLAY, USING NOMINAL VALUE CHIPS, AT LEAST THE TOP WINNERS AT EACH TABLE ADVANCE TOP A NEXT ROUND PLAYED WITH THE SAME GAME FORMAT.

The game of blackjack or "21" was originally played with one deck of 52 cards. It was played worldwide with one dealer and between five and eight players. That was the case until one man—Edward Thorp wrote a book called Beat the Dealer in 1955. It was groundbreaking material that mathematically proved that the game of blackjack could be beat given certain criteria. The casino industry overreacted and thought that they needed to change the rules dramatically to protect the house's profit. The book actually did the opposite—that is it brought millions of new players to the game who thought they could actually win. It resulted in the world's most popular game. The casino industry actually made more profits as players flocked to the game.

Some of the changes the casinos implemented to "protect" their profits were to increase the number of decks used in the game. Another change was not allowing players to double down on any first two cards except "10" and "11". Many books have been written since including Lawrence Revere's book—Blackjack as a Business. He was barred by most all Nevada casino's because of his abilities to win at blackjack. Many other players who read these groundbreaking books and implement their teachings have been and continue to be barred.

Because of all the publicity and casino over-reaction to the game of blackjack the game continues to gain in popularity and exposure. This invention will attract players of all blackjack abilities for the chance to compete for real money in a tournament setting where all the money is from participant's buy-ins. The World Series of Poker is where the best professionals and amateurs play side by side competing for huge prizes like 2006's $12 million dollars for first place. The World Cup of Blackjack with the new format should attract professional blackjack players, professional poker players and amateurs from both poker and blackjack. Turning the event into a more fair and even playing field for all competitors will result in widespread popularity. Multiple events could be conducted with varying buy-in amounts, decks used, number of players at table and rule variations, similar to WSOP multiple events.

It is the intention of this invention to re-kindle the excitement and wide-open betting and playing strategies by only utilizing one deck at each table, especially the main event. This will be possible because only one player hand will be dealt for the "8" table participants. In this way the dealer can deal multiple hands before shuffling. All tables will have only one deck in play with doubling after splits and doubling on any first two cards the rule. This will make for high octane hands with many playing decision variations. It will make for compelling television coverage as the event winds down to the best in the business. The use of card hole cameras to see players' bets and decisions will further enhance the viewing excitement. The casinos or organizations that host this event will be able to profit from all blackjack players—amateur and professional alike. They will receive the rake, the advertising and television revenue along with increased traffic and exposure in their casino or casinos.

Because of the unique features of the invention, that is, only one common hand shared by entire table, table shape can be altered. The standard poker table could be retrofitted with a new top with the World Cup of Blackjack propriety printing and the built-in one deck shuffle-master in the table could be utilized for the single deck format as well.

Because of the logistics of setting up convention rooms in casinos for large international events, both the World Series of Poker and the World Cup of Blackjack could be conducted back to back. They would share the expense of set-up and breakdown but it would be halved. Dealers would be already in place and players could compete back to back but not in conflict with each other. Television cameras and media would already be in place.

The World Cup of Blackjack™ game would benefit from the exposure from the WSOP but could stand alone as well and be conducted by an independent organization. It could and would build upon itself as the word got out that all blackjack players—even barred players could compete for huge cash prizes like WSOP. Celebrities, sports figures like Michael Jordon, Charles Barkley and Tiger Woods all love blackjack and would be attracted to this new format and television exposure.

Up to this point, we have discussed the World Cup of Blackjack as a tournament only experience. However, this invention has another use and/or purpose. This new game will be available to all casinos in an individual game format competing for floor space with traditional blackjack, Let It Ride® poker, Three Card Poker® games, etc. The name of the game "World Cup of Blackjack™" game could be a feeder to the once-a-year main event. A series of satellite tournaments could be held with small buy-in amounts where winner earns a free seat in the main event. Their tables could be placed in a variety of locations—1) a main casino floor in blackjack pit; 2) a Poker-blackjack room where daily tournaments could be conducted.

With the regular non-tournament casino version, the game remains the same, except that regular casino chips replace the chip cards and decision cards become optional. Multiple decks could be utilized or a combination—some single, double, six or even eight deck shoes could be utilized depending on casino's tolerance and electronic tracking systems. This play will maximize revenue per square foot. With the invention, a typical casino will be able to deal anywhere from 35 to 50 percent more hands per hour. All players at the table are making simultaneous decisions on one hand which takes ⅛ the time of dealing individual hands to a full eight person table. The dealer has to deal only four cards initially for up to eight players instead of 18 cards with conventional blackjack. Also since the two players cards are dealt "up" (exposed), no delays will exist like when a player takes excessive time picking up his individual cards (squeezing ) to expose them. Since the players are against only the dealer and don't care if they beat an individual player, decision cards become unnecessary, further speeding up the game. Simple hand signals will be used instead—pointing at the table for hit, flat hand waved parallel to table for stand, and two split fingers for spilt, same for double. The game takes on a craps like feel where the players are all cheering for the same thing. The majority of the time the players will make the same playing decision thus making the turn of the dealer's cards that much more exciting and dramatic. Players will enjoy the team feel that shared cards will bring to the table. The casino will love the increased number of hands per hour which equates to a 35 to 50% increase in profits. The traditional blackjack rules would apply, thus the house edge would remain constant over time. Players would love this game because they will feel that they have more control over the outcome. Players love to play heads up, being able to go one on one with the dealer. This will be the case 100% of the time. There is no need for the player to avoid play when there are multiple players at the table, so the game will result in full tables, with added excitement as a group and a higher profit margin for the casino—a win-win situation.

With only one hand dealt, the dealer will deal six to seven times the amount of rounds per shuffle. Streaks will go on longer coupled with more betting opportunities due to longer runs of cards per shuffle.

The more advanced players will enjoy this new format as well. They enjoy the spotlight and some of their playing decisions will vary from conventional plays. Also with only one hand being dealt for entire table, players will feel that it is to their advantage and will be drawn to these games versus full tables of conventional blackjack. Players enjoy heads-up games and sometimes only play when there are one or two other players at a table. Of course, the casino can and will continue to monitor the skilled player and act accordingly with effective countermeasures. Nevertheless, the majority of so called "skilled" players can't and will never win in the long run for obvious reasons—the casinos have more money, time and control over the game.

With this invention, World Cup of Blackjack™ game, a casino will not have to bar a skilled player. They could simply re-direct them to the World Cup of Blackjack tournament table in their casino where players have a buy-in and for a certain time frame, or number of hands, determine a winner with the winnings coming from other participating players, not from the casino. Different formats of tournaments could be utilized such as a sit and go or a multiple table format similar to poker. These tables could use the same shape as poker tables placed in the poker room or when the popularity warrants it—its own World Cup of Blackjack Room, where satellites are being conducted and individual tournaments played, where professional blackjack players would be welcomed with open arms, and where the casino can "profit" from them.

The new World Cup of Blackjack heads up non-tournament version would create a new game at the casino—guaranteed heads up play against the dealer. There would be no more inconsistent play when one player leaves the table in the middle of a shoe, or a player joins in the middles of the shoe. The cards dealt remain constant, only the total number of players changes. This will be a huge mental boost to players and will attract many players that are superstitious to changes in the number of hands dealt during a shoe.

Another variation is the use of the same game as World Cup of Blackjack—heads up, except that the dealer deals two common hands instead of one and the players can elect to bet both hands, the first only, or the second only (prior to dealing the cards of course). They can alternate during the shoe, going from both, to one and then the other, etc. They can bet different amounts on each hand subject only to minimums and maximums.

With this game, the casino is able to get up to 16 bets per round (eight times two) for only six cards initially dealt. The hands per hour would then be over 50% more than conventional blackjack with the same profit margin—thus providing a 50 to 70% increase in revenue and profit. Only a slight variation need be made to account for the second player hand. The player matrix would be doubled i.e., six squares for hand one and six different squares for hand two. The reason this is necessary is because of the fact that a player can bet different amounts on each hand and as such would have to be separately identified. The players will like the option to play two hands. Many players play two hands as a standard operating procedure, and with this version, they will be able to do just that. The advantage is that no other players are excluded because of the lack of playing squares. All players can play two hands and act totally independently. The play would begin on hand #1 and would continue till all had concluded by an appropriate stand hand signal. Then, the players would signal the second hand the same way as hand #1. The dealer would identify each player's ending total in the respective player's matrix, unless that decision resulted in no more hits for the hand.

Players can enjoy trying to out guess which hand will do better and this format allows them to pick which hand to bet based on whatever criteria they can imagine. If no one bets on a given hand, the dealer still deals out that hand, but simply removes that hand from the felt after dealing. In this way the pattern of the cards will always be two player hands for one dealer hand. No doubling of the table minimum will be necessary (as is required in some casinos), because no players are being left out of play based on one player playing two hands. This will be favorable for the players and casino alike. It will encourage additional bets per round because a player doesn't have to have four times minimum at risk in one given hand like conventional blackjack rules to play two hands, only two times the minimum. The house or casino will like this because more money will be bet per round with increased profits per table.

With both the World Cup of Blackjack—heads up version and the two on one version, the dealer may use the player matrix. That is a recording device for the dealer to identify individual player's totals when a player elects to stop prior to another player on the same hand. An example using the heads up version would be as follows: Assume the players hand is 7-5 for a total of 12. The dealer's up card is 3. Eight players are at the table—players 1-4 signal to stand (hand signal—wave hand parallel to the table), and players 5-8 signal hit (touch table with one finger). To identify players 1-4's stopping point, the dealer takes numbered chips 1, 2, 3 and 4 and places them in the square identified as 16 or less in the players' matrix. The dealer then proceeds to draw another card for the players' common hand as instructed by players 5-8. Assume the next card is an ace for a total of 13 (5-7-A). Player 5, 6 and 7 signal stand, and player 8 signals hit.

Dealer now takes numbered chips 5, 6 and 7 and places them in the 16 or less square in the players' matrix. The dealer then draws another card which is a 7 for a total of 20 (5-7-A-7). There would be no need to identify in matrix since no other players will take another hit, thus player 8's total is identified by the sum total of the player cards left on the table. Now the dealer turns over his hole card which is a 7 for a total of 10 (3-7). He must draw another card and it is a 7 for a total of 17 (3-7-7). At this point, the dealer compares his 17 to all the players' chips in the player's matrix. 17 is more than 16 or less, thus all players 1-7's bets are taken off the table. The markers are removed from the players' matrix. The dealer then compares his 17 to the players cards on the table—20 beats 17, thus the dealer pays player 8 and gathers up the cards and proceeds to the next hand.

Here is an example where no player's identification chips go in the players' matrix. The Players' common hand is 20 (king-queen) and the dealers up card is 7. All eight players signal to stand with a hand signal. Since all signaled to stop at the same point (after the first two player cards) the dealer need not identify the 20 in the players matrix for anyone. All have stopped on 20 and the dealer flips over his hole card which is a 10 for a 17 total. Players' 20 beats the dealer's 17, so the dealer pays all bets from his left to right, clears the cards and proceeds to next hand. This whole process hardly takes any time versus conventional blackjack, which the casino will find very profitable.

All versions use shared player cards with individual decisions and unique and straightforward play. All cards are dealt face up and players are able to quickly execute their decisions, not waiting for all other players to draw individual cards to complete their hands. In this way the action is constant (like craps) where every card turned over is important to player and dealer alike.

With both the heads up version and the 2 on 1 version, players can act in unison with overt hand signals creating a team-like feel with a mob type mentality—us versus the dealer. All skill level players can play together in this format because the inexperienced players won't mess up or delay the other players by misplaying their individual hands as they might in conventional blackjack. The new players can draft off the better more experienced players by following their lead on what to do with a particular playing decision. This invention will speed up the game by reducing dead time between playing decisions for a particular player. Since only one hand or two hands are dealt with the 2 on 1 version, a player is playing and making decisions nearly 100% of the time. This type of constant interaction will keep the players more interested in the game vs. traditional blackjack, where one player is "on stage" making decisions and all the other players are just sitting there. All players play unique hands with separate cards in traditional blackjack leading to player boredom and dead time. Not so with this new invention.

The World Cup of Blackjack—the tournament version is an extension of the heads up game. Where with the addition of decision cards and chip cards, player's decisions for both betting and playing hands remains undisclosed until after the hand is completed. Since all players play the same hand, but bets and decisions are undisclosed between players, the best blackjack player will win the majority of the time. These facts create a tournament where the luckiest player won't necessarily win. The one who has skills in both being able to adjust bet amounts and playing decisions during the course of play based on cards already played in a particular shoe should win the majority of the time. Given this fact, the turnout for this format should lead to a tournament that will rival that of the WSOP in terms of the number of players and prize pool. Given the even playing field in terms of the common hand, the winner at each table will be the person who plays those cards the best and bets more when most appropriate. Also the winner must be able to weather bad beats, poor cards and intense pressure of making split second decisions with all the lights shining down.

This inventive game play is in contrast with current blackjack tournaments where location of a player's seat, which table he sits at and if he gets to act last on final hand usually are the main factors in determining a winner. Conventional blackjack tournaments act more like slot tournaments where seat location is the overriding factor in determining a winner. The World Cup of Blackjack with its level playing field and lack of crazy end of round play will entice more players to pay large entry fees like poker where skill is the overriding determining factor in crowning a champion.

Participants will sign up in a variety of methods. A first method will be direct payment to a website or mailing address for entire buy-in amount of $10,000. Another method is similar to entry in the WSOP where the majority of players enter via satellite tournaments, qualifying for a fraction of the overall cost. Satellites could be held at brick and mortar casinos and licensing the World Cup of Blackjack at online casinos where qualifying tournaments are conducted worldwide insuring huge turnouts and incredible dollar payouts. Common-hand electronic blackjack tournaments will allow for both cash games and satellite feeder tournaments for the $10,000 World Cup of Blackjack main event conducted in a fair and competitive way. Players will be linked via the casinos online web site with deposits made similar to poker tournaments. A given time or number of hands can be used to determine ending time of the qualifying tournament. Both sit and go (single table tourneys) or multiple table formats (with smaller buy-ins) can be utilized. It will truly become a World Championship as players from around the globe will play on the web to qualify for the main event. Play can be with single decks just like the main event format with liberal rules consistent with the main event or with multiple decks. None of the other players' bets or decisions on the common hand will be flashed on the automated computer screen until all wagers have been made. At the end of the hand, the computer screen could superimpose the other player's final hands and also list the cards played during that hand. No mention of the other players' bets or chip stack total will be displayed. This will insure that at the end of a round, players don't play differently in hopes of catching up. Thus luck on last few hands will be less likely to determine the winner.

In summary, this invention creates a new game of 21 where all players at the table receive identical cards. But after the first two cards are dealt to the players each player individually decides how to proceed. Each card that is dealt after the first two applies to all players' hands that have elected to use the additional cards, as players make decisions such as stand, hit, double, split or surrender, the dealer reacts to the decisions collectively. For example if 3 players elect to stand after 1st two cards are dealt, the dealer uses small chips identified with players position number and places them in the players' matrix. The matrix is broken down into 6 different squares: 16 or less, 17, 18, 19, 20 and 21. These numbers represent the card totals of players' meaningful hands after they have decided to stand. This could occur after only 2 cards (at a minimum) or up to 6, 7 or maybe even 8 if all cards are small such as 2, 3 aces, etc.

The matrix is used to help the dealer keep track of players' total card count with multiple players. If all players decide to stand on 1st two cards, however, no matrix identification would be necessary since all would share the same player's total. If three players decide to stand and five decide to hit after seeing first two cards, dealer would use the matrix to indicate card totals for the three players who decided to stand. The dealer would draw another player card and again wait for players' decisions. If all five remaining players elect to stand, dealer would immediately proceed to complete the play on his hand and compare his total to the three cards in the player area. Then the dealer would compare his total to the three players who elected to stand after the first two cards were dealt. Those three players would be identified in the players' matrix area.

This invention benefits both the player and the casino in different ways. The casino is able to increase the total number of hands dealt per hour by approximately 30 to 40% with the heads up version (one common player hand) and up to 50% more hands with the two on one version (2 common players' hands versus one dealer hand). This is possible by the unique card delivery system and shared decision process between players. Assuming eight players at a table with conventional blackjack, 18 different cards must be dealt out. With the present invention, only 4 cards are dealt, which provides an immediate time saving. Next, the players with conventional blackjack each make unique decisions based on their exclusive two cards, taking hits, doubling, splitting etc. while the other seven players just sit there with nothing to do. This is time consuming for each player. The present invention streamlines the process by having all eight players share the identical first two cards that are dealt face up. At this time, all eight players act individually but at the same time on how to complete the hand. Most of the time the decisions will be identical allowing the dealer to complete his hand and compare the dealer hand with the shared player hand, paying all or taking all. This process will take a fraction of the time as compared to conventional blackjack. More hands per hour with identical house advantage equals increased revenues with no increase in casino expense.

One trend in the casinos is utilizing 6/5 blackjack payouts instead of traditional 3/2 payouts. With the 2% extra house edge, due to the weakened blackjack payout, casinos are rolling out the single deck games again. Most major strip Las Vegas casinos have added this 6/5 game to their lineup of table games. The present invention will flourish with the single deck 6/5 payout game. Instead of only getting one hand between shuffles with a full table using conventional blackjack dealing, the World Cup of Blackjack will allow for 6 or 7 hands before shuffling allowing for increased hands per hour and increased profits as a result. With the 6/5 blackjack payout, the heads up version of the present invention will attract many additional players who like to play single deck but don't enjoy playing at a full table. Both the player and casino will enjoy this combination. With a 30 to 50% increase in profits with no additional risk of loss the casino's accountants, stockholders and executives will demand the World Cup of Blackjack in their casinos to replace conventional blackjack games.

There are significant advantages to the player as follows:

1. Direct heads up play against the dealer, either with one player hand or two hands against dealer.

2. All cards commonly apply to all players' hand, with no second guessing or missing out on a card going to another player's hand.

3. Rookie mistakes never affect play of hand unlike conventional games where the play of another player's hand seems to adversely affect outcome of a later player's hand.

4. This avoids creating bad blood between players when a certain player misplays their hand, with all players encouraging each other by sharing information on how to play the common hand. This leads to a team-type atmosphere similar to craps. Players new to blackjack will enjoy this team feel and learning experience. Many new players will flock to this game solely based on this team concept.

5. Players won't get bored waiting around for their turn unlike a full table in conventional blackjack. Thus, no player will shy away from a full table. The higher the average number of players per table, the higher the profit for the casino—a win/win situation.

6. The player will receive many more hands per shuffle with the new game versus a full conventional blackjack game. Players love to bet streaks and increase bet amounts during an individual shoe. With 6 to 7 times the number of hands per shuffle the player will be able to "chip" up bets much longer allowing for increased excitement and drama.

7. Another complaint of blackjack players is when a player joins or leaves a table in the middle of shoe. It seems to always hurt the player when these events occur. With play of the present invention, these concerns are eliminated. Since all initial cards are always common two player cards and two dealer cards, regardless of the total number of players the sequence of dealt cards always remains constant. Players enjoy consistency and with the shared player's cards, no player joining or leaving in the middle of a shoe affects remaining hands dealt.

The present technology includes a description of a method of playing a casino table wagering game of blackjack using a video display, a processor and player input system. The method includes:

at least one player placing individual wagers on an underlying blackjack game;

an initial 2-card common player hand is dealt with virtual playing cards provided by the processor to the video display;

an initial 2-card dealer hand is dealt and displayed on the video display, with rank of one card of the initial 2-card dealer hand exposed to view;

each player making independent decisions on the play of the player's hand through the player input system to complete of the common hand for each individual player's hand, each player using only community cards to complete the common hand;

the processor completing the dealer's hand; and the processor resolving all wagers.

What is claimed:

1. A method of playing a casino table wagering game of blackjack using a video display, a processor and player input system comprising the steps of:

at least one player placing individual wagers on an underlying blackjack game;

an initial 2-card common player hand is dealt with virtual playing cards provided by the processor to the video display;

an initial 2-card dealer hand is dealt and displayed on the video display, with rank of one card of the initial 2-card dealer hand exposed to view;

each player making independent decisions on the play of the player's hand through the player input system to complete of the common hand for each individual player's hand, each player using only community cards to complete the common hand;

the processor completing the dealer's hand; and the processor resolving all wagers.

2. The method of claim 1 wherein cards completing the common hand are dealt to a common area viewable by each player.

3. The method of claim 1 wherein cards completing the common hand are dealt only to the common hand but are displayed by a video screen to each player.

4. The method of claim 3 used in a blackjack tournament.

5. The method of claim 4 wherein the tournament includes multiple tables and multiple rounds of play.

6. The method of claim 5 wherein identical common player cards are used in hands at multiple tables for each round of play.

7. The method of claim 5 wherein players are provided with virtual decision cards and players use the virtual decision cards to indicate blackjack game decisions.

8. The method of claim 4 wherein a series of player count identifying areas are provided and individual players place player identifiers in at least one of the player count identifying areas.

9. The method of claim 8 wherein the player count areas comprise six areas separately representing player counts of a) 16 or less, b) 17; c) 18; d) 19; e) 20; and f) 21 and a player places an individual player identifier into at least one player count area.

10. The method of claim 8 wherein players are provided with virtual decision cards and players use the virtual decision cards to indicate blackjack game decisions.

11. The method of claim 10 wherein individual decision cards include at least choices selected from the group consisting of stand, hit, double down and split.

12. The method of claim 9 wherein players are provided with virtual decision cards and players use the virtual decision cards to indicate blackjack game decisions.

13. The method of claim 12 wherein players use their virtual decision cards on each wagering opportunity by placing information sides of the decision cards face down, committing to a decision on a particular card, and then all players' virtual decision cards are then displayed and an exposed decision on the virtual decision card is acted upon.

14. The method of claim 1 wherein a series of player count identifying areas are provided and individual players place player identifiers in at least one of the player count identifying areas.

15. The method of claim 14 wherein the player count areas comprise six areas separately representing player counts of a) 16 or less, b) 17; c) 18; d) 19; e) 20; and f) 21 and a player places an individual player identifier into at least one player count area.

16. The method of claim 1 wherein at least two separate common player hands are dealt and individual players place a separate wager on either of the at least two hands or both of the at least two hands.

* * * * *